United States Patent [19]

Dove

[11] 4,320,583

[45] Mar. 23, 1982

[54] STEAM DISTRIBUTION APPARATUS FOR FLAT PAPER SHEET

[76] Inventor: Norman F. Dove, 3187 Hesigns Rd., North Vancouver, Canada, 37J 3B5

[21] Appl. No.: 162,585

[22] Filed: Jun. 23, 1980

[51] Int. Cl.[3] ..... F26B 13/10

[52] U.S. Cl. ..... 34/54; 34/160; 162/375; 162/DIG. 6

[58] Field of Search ..... 162/290, 375, DIG. 6, 162/207; 34/155, 156, 160, 54; 239/557, 601

[56] References Cited

U.S. PATENT DOCUMENTS

| | | | |
|---|---|---|---|
| 3,085,347 | 4/1963 | Justus | 34/54 |
| 3,089,252 | 5/1963 | Daane et al. | 34/114 |
| 3,777,781 | 12/1973 | Dove | 162/290 |

*Primary Examiner*—Larry I. Schwartz

*Attorney, Agent, or Firm*—Richard H. Zaitlen

[57] ABSTRACT

Apparatus to supply steam to a paper sheet passing beneath it. The apparatus has a leading edge and a trailing edge relative to the sheet direction and comprises at least two headers, a first header being adjacent to the leading edge. There is a steam supply system means for the headers. A profiling chamber is formed between the headers and baffles which divides the profiling chamber into compartments. There is provision for a controlled supply of steam to each compartment. Outlets in the profiling chamber permit steam to be projected towards the sheet from the compartments. A further chamber is formed adjacent to the leading edge and steam can be supplied to the chamber. Outlets in the further chamber permit steam to be directed towards the sheet to form a steam curtain at the leading edge of the apparatus to prevent air being drawn under the apparatus by the sheet.

19 Claims, 7 Drawing Figures

STEAM DISTRIBUTION APPARATUS FOR FLAT PAPER SHEET

FIELD OF THE INVENTION

This invention relates to a steam supply apparatus particularly useful in the application of steam to a paper sheet passing beneath it.

DESCRIPTION OF THE PRIOR ART

The benefits to be derived from the application of steam to the paper sheet during the paper making process are well known. The resulting increase in sheet temperature provides increased water drainage rates, thus reducing the amount of water to be evaporated in the dryer section. Further by varying the amount of steam applied to various parts of the sheet in the cross machine direction the cross machine moisture profile of the sheet may be modified so that the moisture profile at the reel is more uniform.

Water drainage from the sheet is improved after the application of steam primarily because heating the sheet reduces the water viscosity thus increasing the ability of the water to flow.

In order to derive maximum benefit the steam heater must clearly be efficient. The main heat transfer takes place when the steam condenses in the sheet. A change of state takes place when the steam condenses and transforms the latent heat of the steam to sensible heat in the water. To provide an effective steam heater therefore it is imperative to provide the highest possible rate of steam condensation in the paper sheet.

The three major requirements of a steam heater for heating a paper sheet are:

1. Maximum heat transfer, thus ensuring the maximum possible rise in temperature, with minimum steam use.
2. Compact design enabling the best possible use of the available space.
3. A design having clean lines to prevent fibre build up.

Heat transfer efficiency is increased by providing a heating zone that is free of air, a non-condensible gas. It is known that the presence of non-condensible gases in steam greatly reduces the rate of steam condensation, for example by a factor of the order 4 to 1. The prior art provides little means to reduce the air inclusion in existing steam supply apparatus. The most common approach has been to spill voluminous amounts of steam from the heating zone area to attempt to block out the laminar flow of air entering the heating zone by being carried along with the fast moving paper sheet. The air enters the heating zone through the clearance between the leading edge of the bottom shroud and the sheet. If no attempt is made to prevent air entering the heating zone then for a typical 240" wide machine operating at 2500 fpm with a leading edge clearance between the unit and the sheet of $\frac{3}{8}$" the amount of air entering the machine (cross machine width$\times\frac{3}{8}$th"$\times$speed of the paper sheet) will be 1562 cfm.

Other factors required for an effective steam heater include (a) uniform steam distribution in the cross machine direction, where the principal heating of the paper sheet takes place in the preheat section (b), the ability to vary the steam supply in the cross machine direction to compensate for variation in water content in the sheet after the preheat section (so called profiling) and (c) condensate removal.

SUMMARY OF THE INVENTION

The present invention seeks to provide a steam supply apparatus having maximum heat transfer efficiency, low steam use, and compact design using the minimum amount of space over flat surfaces, such as on the fourdrinier table or over the sheet on flat felt runs, that provides uniform steam distribution in the preheat section, good ability to profile and all the necessary condensate removal.

In particular the present invention seeks to provide greatly improved exclusion of air from the heating zone, compared with the prior art, cross machine uniformity of steam supply in the preheat section and good control of profiling.

Accordingly, the present invention is an apparatus to supply steam to a paper sheet moving beneath it the apparatus having a leading edge and a trailing edge relative to sheet direction and comprising a first header generally adjacent the leading edge; a second header spaced from the first; a third header spaced from the second to be generally adjacent the trailing edge; steam supply means to the first, second and third headers, upper and lower spaced walls extend between the first and second headers to define a first steam chamber; first passageways through which steam may pass from the first and second headers into the first steam chamber; second passageways through which steam may pass from the first chamber downwardly towards the sheet; a second steam chamber extending from the first headers towards the leading edge; third passageways through which steam may pass from the first header into the second steam chamber; means defining an outlet for steam to pass from the second steam chamber downwardly towards the sheet to form a steam curtain at the leading edge of the apparatus to prevent air being drawn into the heating zone by the sheet; upper and lower spaced walls extending between the second and third headers to define a third steam chamber; a plurality of baffles formed in the third steam chamber to divide the chamber into a plurality of compartments; means to regulate the flow of steam between the second headers and each compartment of the third steam chamber; fifth passageways to enable steam to pass into the third steam chamber from the third header; and sixth steam passageways to enable steam to pass downwardly from the third steam chamber to contact the sheet beneath the apparatus.

In the apparatus of the present invention air is prevented from entering the heating zone by means of a "steam curtain" that consists of one or more narrow bands of steam that impinge on the sheet, for the full cross machine direction, at the leading edge of the unit. The steam curtain provides an effective barrier against the air boundary that follows the sheet as discussed above.

Uniform steam distribution in the cross machine direction is achieved in the present apparatus throughout a very wide operating steam flow requirement. It is imperative that uniform distribution be accomplished in the preheat section to ensure that the sheet is uniformly heated in the cross machine direction. If there is a variation in the cross machine direction steam output the sheet would not be heated uniformly and the result would be a disturbance of the cross machine moisture profile. One method of accomplishing uniform steam output in the cross machine direction for a known, given flow rate, would be to calculate the required steam outlet opening (that is the second passageways), to compensate for drop in steam pressure as the steam proceeds down the first chamber in which the second passageways are formed. This method is effective for any one given steam flow rate but becomes inadequate when the total steam flow rate is varied across an expected operating range. This invention provides a means of providing uniform steam distribution in the cross machine direction for a very wide flow range.

The apparatus also permits the selective interruption of the uniformity of steam distribution, after the preheat section, in order to establish temperature differentials across the sheet that compensate for variations in the cross machine moisture profile of the sheet. Where the sheet contains relatively more water the sheet temperature would be relatively increased to increase the water drainage rate at that location and thus provide means of preferentially removing more water from the location. This function is achieved by the baffles in the third steam chamber dividing the chamber into a plurality of compartments and the means to regulate the flow of steam between the second header and each compartment of the third steam chamber. This arrangement ensures that the output of steam from the sixth steam passageways can be controlled.

BRIEF DESCRIPTION OF THE DRAWINGS

Aspects of the invention are illustrated in the accompanying drawings in which.

DESCRIPTION OF THE PREFERRED EMBODIMENTS

The drawings illustrate an apparatus to apply steam to a paper sheet 2 moving beneath it in the direction of the arrow A. The apparatus has a leading edge 4 and a trailing edge 6 relative to movement of the sheet 2.

Figure 1:
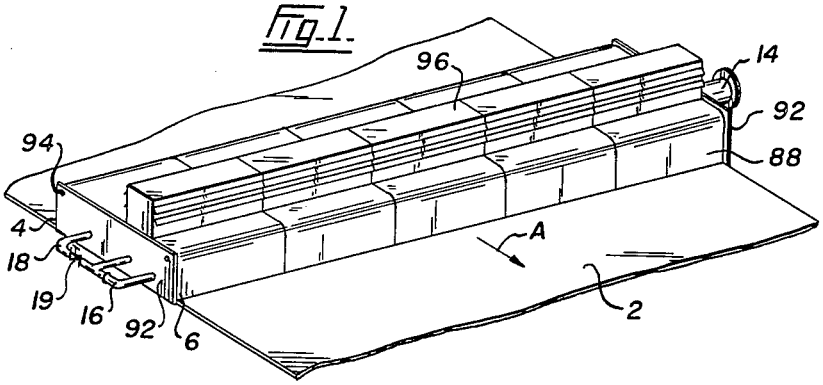
FIG. 1 is a general view of an apparatus according to the present invention positioned transversely across a paper sheet.
Figure 2:
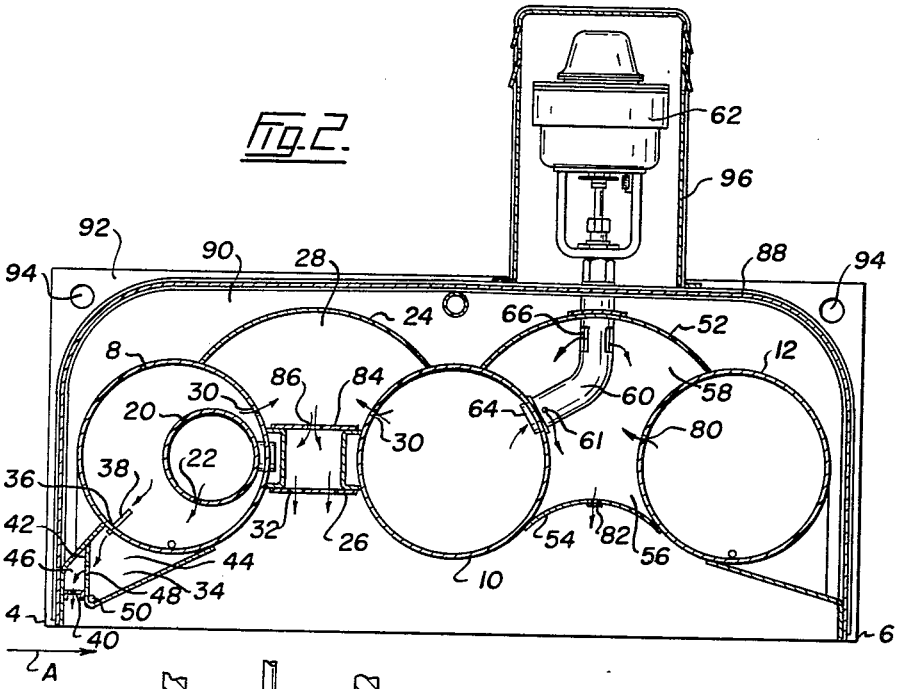
FIG. 2 is a section of the apparatus of FIG. 1.

As shown more particularly in FIG. 2 the apparatus comprises a first header 8 generally adjacent the leading edge 4. There is a second header 10 spaced from the first and a third header 12 spaced from the second to be generally adjacent the trailing edge 6. There is a steam supply means for the second and third headers indicated generally in FIG. 1. There is an inlet 14 at one end of the apparatus. The supply of steam is subdivided at the other end through branch pipes 16 and 18. A control valve 19 may be present in pipe 18. Thus steam supply is from a conventional steam source in the paper making mill to the second header 10 and, through the branch pipes 16 and 18 at the other end of the apparatus, into the first and third headers 8 and 12. In this regard it should be noted that in FIG. 2 there is a fourth header 20 positioned eccentrically within the first header 8. Header 20 has outlets 22. Fourth header 20 receives steam from the branch pipe 18.

An upper wall 24 and a lower wall 26 extend between the first header 8 and the second header 10 to define a first steam chamber 28. There are first passageways 30 through which steam may pass from the first header 8 and the second header 10 into the first steam chamber 28. There are second passageways 32 in the lower wall 26 through which steam may pass from the first chamber 28 downwardly towards the sheet 2 passing beneath it.

There is a second steam chamber 34 extending from the first header 8 towards the leading edge 4 of the apparatus. Third passageways 36 permit the passage of steam from the first header 8 into the second steam chamber 34. In the illustrated embodiment of FIG. 2 there are tubes 38 formed in the third passageways 36 to prevent the passage of condensation. There are fourth passageways 40 through which steam may pass from the second chamber 34 to go downwardly towards the sheet 2 to form a steam curtain at the leading edge 4 of the apparatus. The steam curtain is formed by steam passing through the fourth passageways 40 which may be of the configuration generally illustrated in FIGS. 4 and **4*a*. That is they comprise a plurality of openings arranged in a plurality of rows. The arrangement is that the openings be staggered in each row relative to the openings in the neighbouring rows. However, a single slot extending the length of chamber 34 may be used 4*b*. Generally a plurality of rows is preferred with increasing speed of the sheet 2. These same configurations of openings are also appropriate for passageways 32 in chamber 28**.

In the illustrated embodiment of FIG. 2 the second steam chamber 34 is subdivided by a wall 42 into subchambers 44 and 46 to prevent condensation passing through the fourth passageways 40. First subchamber 44 receives steam from the first header 8. The second subchamber 46 contains the fourth passageway 40. There are openings 48 between the subchambers so that steam may pass between them. The lowermost point of the first subchamber 44 is lower than the second subchamber 46 to act as a condensation trap. A trap 50 is used to remove condensation from the first subchamber 44.

There is an upper wall 52 and a lower wall 54, spaced from each other, extending between the second and third headers to define a third steam chamber 56. A plurality of baffles 58 are formed in the third steam chamber 56 to divide the third steam chamber 56 into a plurality of compartments, typically 20 in the cross machine direction. There are means to regulate the flow of steam between the second header and each compartment of the third steam chamber 56. As shown in FIG. 2, in the illustrated embodiment the regulating means comprises a pipe 60 extending from the second steam header 10 through the third steam chamber 56 to a profiling valve. There is an inlet 64 for the pipe 60 in the second steam header 10 and an outlet 66 in the pipe 60 formed in the third steam chamber 56. A minor outlet 61 is also formed in the third steam chamber 56 to ensure a constant supply of steam to chamber 56 while the apparatus is in use.

Figure 3:
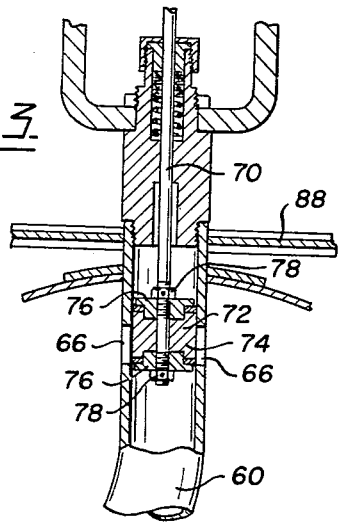
FIG. 3 is a detail of the apparatus of FIGS. 1 and 2.

The profiling valve is shown in detail in FIG. 3. The valve consists of conventional valve components but is modified by the addition of a connecting rod 70 attached to a piston 72 with a remote valve actuator 62. The piston comprises a solid body 74 located by end caps 76 which, in turn, are located by nuts 78 on a threaded end of the connecting rod 70. There are low friction guides, for example of Teflon, inserted between the end caps 76 and the bodies 74 to facilitate sliding of the pistons within the pipes 60. Steam is typically fed into the inlet 64 from the second steam header 10 at a pressure in the range up to 1 atmosphere. The actuator 62 can be preset to ensure that the steam supply to an individual compartment remains constant despite variations in the steam supply flow rate from the second steam header 10. Furthermore, it can be arranged that the amount of steam delivered to each compartment varies and, in this way, the amount of steam applied to the sheet from the third steam chamber 56 can be controlled, or profiled, across the paper sheet 2.

In the illustrated embodiment the third chamber 56 also receives steam through fifth passageways 80 which enable steam to pass from the third header 12 into the third chamber 56.

Steam passes from the third steam chamber 56 from sixth steam passageways 82 formed in the lower wall 54 of the third steam chamber 56. Again the configuration of passageways 82 may be as shown for passageways 40 shown in FIGS. 4 to 4B.

It should also be noted that the illustrated embodiment of FIG. 2 includes a dividing wall 84 in the first steam chamber 28 between the upper wall 24 and the lower wall 26. There are passageways 86 formed in the dividing wall 84 to permit steam to pass through. The presence of the dividing wall 84 is to provide a pressure dampening zone prior to the steam leaving the first steam chamber 28.

The apparatus according to the present invention includes a casing 88 extending around the headers 8, 10 and 12 and down towards the leading edge 4 and the trailing edge 6. The space defined between the headers and steam chambers is desirably packed with an insulating material 90. The apparatus has end plates 92 with holes 94 to provide means of lifting the unit and brackets (not shown) for supporting the unit. Valve actuators 62 are enclosed within a casing 96 to protect them from the machine room environment.

In use the illustrated apparatus according to the present invention functions as follows. Machine direction is shown by the arrow A.

STEAM SUPPLY

Steam enters the unit through inlet 14 which discharges into header 10. A constant pressure is maintained in header 10 by either (a) pressure controlling the steam supply to nozzle 14 with a pressure control valve (not shown) installed in the external steam supply piping that controls the downstream feed pressure leading to the unit or (b) for cases when steam output from the unit is required to fluctuate i.e. for cases when machine direction moisture profile is to be influenced by the unit, back pressure control valve 19 is installed in branch pipe 18. For this case control valve 19, shown in FIG. 1, uses and controls the back pressure developed in header 10. With this arrangement if there is an increase or decrease in flow to header 10 the corresponding change in pressure will be compensated for by either adding or subtracting the steam flow delivered to header 20. It is imperative that the pressure in header 10 be stable in order to ensure that the profiling function of the unit is not influenced by the preheat function, i.e. the feed pressure to each profiling valve must remain constant to ensure that the cross machine moisture profile is not influenced by swings in the steam flow rate being delivered to the unit.

To ensure that the entire unit is heated uniformly regardless of the operating position of any of the valves installed on the unit, steam is allowed to discharge from header 10 via passageways 30 and 64 to discharge steam to both sides of the unit. Minor outlet 61 in pipe 60 preceding the profiling valve discharges steam into chamber 56. The volume of steam discharged from passageways 30 and outlets 61 is restricted by the hole sizing so that the steam flow will have little effect on heating the sheet passing beneath the unit, but will be adequate for filling the entire internal structure of the unit for unit heating purposes.

STEAM CURTAIN

The operating position of the equipment would normally be with the bottom shroud of the unit $\frac{3}{8}''$ above the moving paper sheet. As shown above this clearance would normally permit large volumes of unwanted air to pass under the unit and enter the heating zones. However, it is imperative to condense the steam in an environment that is void of non-condensible gases. This is especially true for the type of equipment according to the invention as the retention time in the heating zone is relatively small. With a paper machine that is operating at a speed of 2500 ft per minute as in the above calculation, with a heating zone width of 1 ft. in the machine direction, the sheet is only under the unit and in the heating zone for a time of 0.024 seconds.

Figure 4:
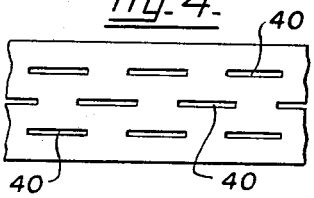
FIGS. 4, 4A and 4B are further details of the apparatus.
Figure 4A:
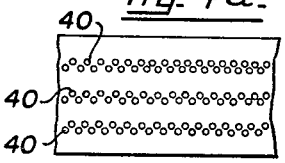
Figure 4B:
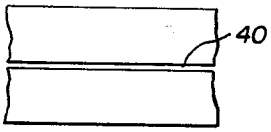

To prevent air from entering the heating zone an important part of the function of the apparatus of this invention is to effectively close the clearance between the leading edge of the unit and the moving paper sheet 2. The concept is to form a steam curtain, as follows:

Steam enters tubes 38 and discharges into chamber 34. Tube 38 ensures that condensate is not discharged from header 8 into second chamber 34. The purpose of chamber 34 is two-fold, (a) to provide a means of collecting condensate that may be formed during the heating of the unit, and (b) to provide a pressure dampening zone in the cross machine direction to assist in the uniform distribution of steam in the cross machine direction from passageways 40. Condensate is collected through chamber 34 from tap 50. Tube 38 is positioned such that it is not in direct alignment with the openings 48 that communicate chamber 34 with subchamber 46. Steam discharges from chamber 34 into subchamber 46 and then via fourth passageways 40 to the sheet. The design for passageways 40 is such that a wall of steam is formed across the machine with no clear line of sight through it. This can be accomplished by using staggered slots as shown by FIG. 4 but, preferably, rows of holes as shown in FIG. 4*a*. The holes would normally be less than 0.05" in diameter and located on isometric centers such that the second row of holes would overlap the edges of the two holes either side of the second row hole, thereby forming a barrier. A single slot may also be used, particularly if the sheet is moving at relatively low speed.

STEAM HEATING OF THE SHEET

This invention permits a uniform steam distribution in the cross machine direction throughout a very wide operating steam flow requirement. This steam is used to preheat the sheet uniformly in the cross machine direction. To ensure a means of providing uniform steam distribution in the cross machine the apparatus functions as follows:

Steam is supplied to pipe 20 via header 18. Outlets 22 are calculated for a predetermined mid-flow range of the preheat chamber. The outlets 22 in header 20 become progressively larger between the first and last hole to be supplied with steam.

Header 20 is positioned eccentrically as shown in FIG. 2. Steam discharges from outlets onto the inside wall of header 8. Due to the eccentric location of header 20, the steam travels around the inside wall of header 8 and expands since the available cross sectional area has increased. This expansion provides a first pressure change which assists towards smoothing out the cross machine pressure variance. The steam is then forced to converge towards first passageways 30. This results in an increase in steam velocity which provides the second pressure dampening zone in the cross machine direction. The passageways 30 are of equal diameter and equally spaced along the length of header 8. Steam is discharged from the passageways 30 into first chamber 28 which is yet another expansion chamber that provides a third cross machine pressure dampening zone. Steam discharges through passageways 86 in the wall 84 which are centered over lower wall 26. The steam enters the space between walls 84 and 26 providing a pressure dampening zone prior to discharge via passageways 32. At this stage the cross machine steam pressure is uniform and hence the steam output from wall 26 via second passageways 32 is uniform because steam flow rate is a function of the pressure differential across the available open cross sectional area.

The steam from the passageways 32 represents the main supply of heat to the sheet passing beneath it for the preheat function. It should be noted that the relative positioning of the outlets 22 and the first passageways 30 in pipe header 8 is important. The illustrated position is ideal in that it forces the steam to travel a path that provides a pressure dampening effect to assist in cross machine distribution. This is accomplished with an increase in available cross-sectional area and a final convergence prior to passageways 30. An arrangement in which the outlets 22 and the passageways 30 are too close would not be suitable as the full dampening affect would not be achieved; the steam would pass by the shortest possible route from outlets 22 to passageways 30. However, in the illustrated arrangement of FIG. 2 the steam must move the maximum possible distance and with the pressure dampening effect provides uniform output to chamber 28 via passageways 30.

PROFILING

A further function of the unit is to selectively interrupt the uniformity of steam distribution in order to establish temperature differentials across the sheet 2 that will compensate for variation in the cross machine moisture profile of the paper sheet, i.e. where the sheet contains relatively more water the sheet temperature will be relatively increased to enhance the water drainage rate at that location and thereby provide means for preferentially removing more water at the desired location. To accomplish this third steam chamber 56 is compartmentized by baffles 58 with each compartment supplied with steam via an independent and separately controlled steam supply source.

The steam supply source as shown in FIG. 2 operates as follows:

Steam enters pipe 60 via inlet 64 which is integral to header 10 and discharges from openings 66 into third chamber 56. The steam flow rate is adjusted by raising or lowering the piston 72 which restrict openings 66 as shown in FIG. 3. A typical sealing arrangement is also shown in FIG. 3, discussed above. Control of the piston can be by hand operation or, preferably, with an air actuator as shown by 62 in FIG. 2. The actuator can be controlled either remotely by an operator who would manipulate a manual loader and/or by an on-machine computer. For the case where an on-machine computer is used means are required to measure the moisture content of the sheet at the reel. Such a means is commonly used and commercially available, and in essence the electronic signal generated, which corresponds to the moisture level, is converted to a pneumatic signal to the actuator of the profile control valve. A higher sensed moisture level would result in a higher steam flow from the corresponding moisture profile chamber.

Steam discharges from chamber 56 through passageways 82. The steam is discharged onto the sheet 2 in a manner that would compensate for the speed of the paper sheet, i.e. the faster the sheet, the greater the angle of steam discharge in relation to the sheet.

Chamber 56 may also be supplied with steam through third header 12. Header 12 is supplied with steam through branch pipe 16 which may be equipped with a flow control valve. Steam discharges from header 12 through fifth passageways 80 which communicate with each of the profiling compartments. This arrangement provides a means to raise or lower the available operating range of the steam output from moisture profile control chamber 56.

Figure 5:
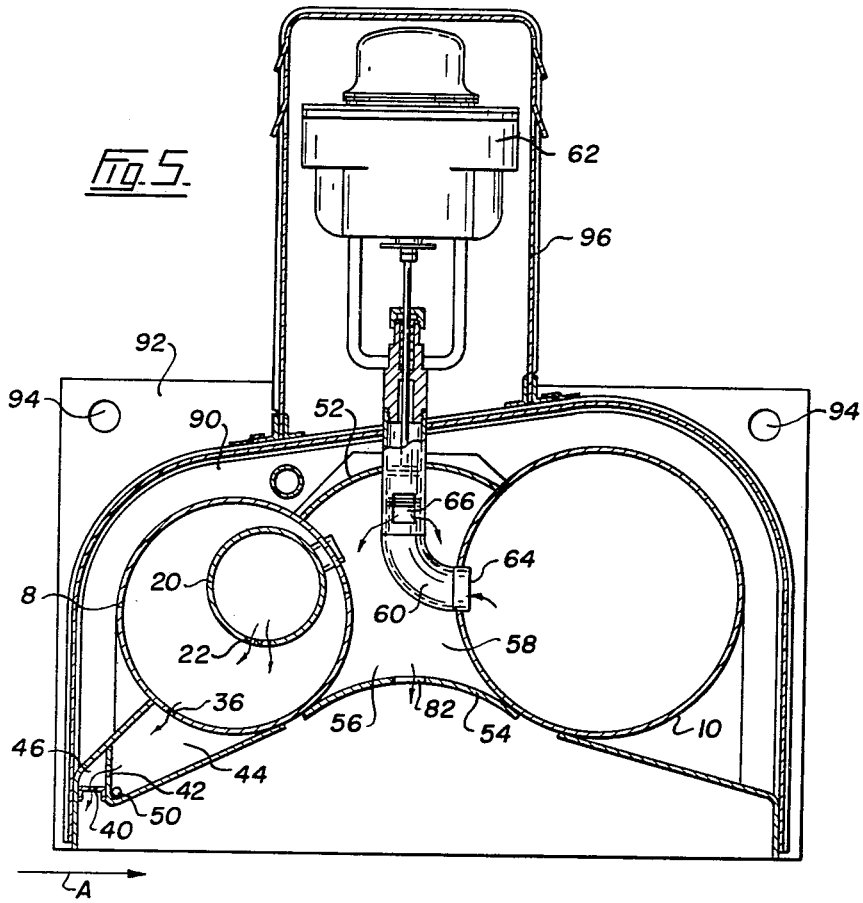
FIG. 5 illustrates a section of a further embodiment of an apparatus according to the present invention.

FIG. 5 illustrates a simplified form of the apparatus of the present invention in which the profiling and preheating function are combined in chamber 56. In general the same reference numerals are used for parts of the apparatus used in FIG. 5 common to the apparatus of FIG. 2. In the apparatus of FIG. 5 the third header 12 is not present and steam passing through passageways 82 performs the function both of profiling and of carrying out the main heating of the sheet. In this regard it should, of course, be borne in mind that steam passing through passageways 40 to form the steam curtain will also have a heating affect. The apparatus of FIG. 5 finds particular application where there is limited space in the machine direction of the papermaking machine.

As will be noted from an examination of the drawings the structural features of FIG. 5 are precisely the same as in the apparatus of FIG. 2 the apparatus of FIG. 5 omits the third header 12 and the first steam chamber 24 but still provides an excellent means of heating a paper sheet passing beneath it.

Thus the present apparatus represents an efficient apparatus for applying steam to a paper sheet. First the apparatus provides a simple yet efficient means of excluding air from the heating zone, thus preventing the undesirable affects of a non-condensible gas within the steam. Secondly the heating function of the apparatus is carried out by a uniform supply of steam in the cross machine direction. Thirdly, the profiling function, carried out after the preheating, achieves optimum control flexibility for cross machine moisture deviation.

I claim:

1. Apparatus to supply steam to a paper sheet moving beneath it, the apparatus having a leading edge and a trailing edge relative to sheet direction and comprising:

a first header generally adjacent the leading edge;

a second header spaced from the first;

a third header spaced from the second to be generally adjacent the trailing edge;

steam supply means to the first, second and third headers;

upper and lower spaced walls extending between the first and second headers to define a first steam chamber;

first passageways through which steam may pass from the first and second headers into the first steam chamber;

second passageways through which steam may pass from the first chamber downwardly towards the sheet;

a second steam chamber extending from the first header towards the leading edge;

third passageways through which steam may pass from the first header into the second steam chamber;

a fourth passageway through which steam may pass from the second steam chamber downwardly towards the sheet to form a steam curtain at the leading edge of the apparatus to prevent air being drawn under the apparatus by the sheet;

upper and lower spaced walls extending between the second and third headers to define a third steam chamber;

a plurality of baffles formed in the third steam chamber to provide the chamber into a plurality of compartments spaced across the width of the sheet;

means to regulate the flow of steam between the second header and each compartment of the third steam chamber;

fifth passageways to enable steam to pass into the third steam chamber from the third header;

sixth steam passageways to enable steam to pass downwardly from the third steam chamber to contact the sheet passing beneath the apparatus at set predetermined parts ot the sheet.

2. Apparatus as claimed in claim 1 in which the second steam chamber is formed with an internal wall to divide it into subchambers to prevent condensation passing through the fourth passageways onto the sheet, a first subchamber to receive steam from the first headers;

a second subchamber in which the fourth passageway is formed;

passageways between the subchambers to allow steam to pass from the first to the second subchambers;

the lowermost point of the first subchamber being below the second subchamber to act as a condensation trap;

a tap in the first subchamber to remove condensation.

3. Apparatus as claimed in claim 1 in which the first steam chamber is subdivided by a wall positioned between the upper and lower walls that define the chamber;

passageways formed in the dividing wall to permit steam to pass through providing a pressure dampening zone prior to the steam passing to the sheet.

4. Apparatus as claimed in claim 1 in which the fourth passageway comprises a single slot extending in the cross machine direction.

5. Apparatus as claimed in claim 1 in which the fourth passageway comprise a plurality of openings arranged in rows each at differing distances from the leading edge of the apparatus, the openings in each row being staggered in relation to the openings in the adjacent row.

6. Apparatus as claimed in claim 5 in which the openings comprise a plurality of rows of slots or holes.

7. Apparatus as claimed in claim 1 in which there is a pipe connecting each compartment of the third steam chamber to the second steam header;

an inlet for each pipe in the steam header;

an outlet for each pipe in each compartment;

a pressure responsive valve actuator associated with each pipe;

a piston extending from the valve actuator to the pipe outlet of each compartment whereby control of the steam supply from the pipe to the compartments can be achieved to provide control of the steam output through the sixth passageways in the cross machine direction.

8. Apparatus as claimed in claim 1 including a casing extending around the headers down towards the sheet to define a space between the pipes and the casing;

heat insulating material positioned within the casing.

9. Apparatus as claimed in claim 1 in which there is a fourth header arranged eccentrically within the first header to receive steam from the steam supply means; outlets formed in the fourth header at points remote from the first passageways so that steam may pass from the fourth header to the first header, the eccentric arrangement and the relative positions of the outlets ensuring uniform flow of steam from the first passageways in the first header.

10. Apparatus to supply steam to a paper sheet passing beneath it the apparatus having a leading edge and a trailing edge relative to the sheet direction and comprising:

at least two headers, a first header being adjacent the leading edge and a second header adjacent the trailing edge;

steam supply means for the headers;

a profiling chamber formed between the headers;

a plurality of baffles dividing the profiling chamber into a plurality of compartments spaced across the width of the sheet;

means to provide a controlled supply of steam to each compartment from said second header;

passageways in said profiling chamber so that steam may be projected towards the sheet from the compartments in a controlled manner;

a further chamber adjacent the leading edge;

passageways in said first header to permit the supply of steam to said further chamber from said first header; and passageways in said further chamber whereby steam may be directed towards the sheet to form a steam curtain at the leading edge of the apparatus to prevent air being drawn under the apparatus by the sheet.

11. Apparatus as claimed in claim 10 in which there are two headers and the profiling chamber is formed by an upper wall and a lower wall extending between the two headers.

12. Apparatus as claimed in claim 10 in which the further chamber is formed with an internal wall to divide it into subchambers to prevent condensation passing through the passageways in said further chamber onto the sheet, a first subchamber to receive steam;

a second subchamber in which the passageways are formed;

passageways between the subchambers to allow steam to pass from the first to the second subchamber;

the lowermost point of the first subchamber being below the second subchamber to act as a condensation trap; and a tap in the first subchamber to remove condensation.

13. Apparatus as claimed in claim 10 in which the passageways in said further chamber comprise a single slot extending in the cross machine direction.

14. Apparatus as claimed in claim 10 in which the outlets in the further chamber comprise a plurality of openings arranged in rows, each at differing distances from the leading edge of the apparatus, the openings in each row being staggered in relation to the openings in the adjacent row.

15. Apparatus as claimed in claim 14, in which the openings comprise a plurality of rows of slots.

16. Apparatus as claimed in claim 10 in which there is a pipe connecting each compartment of the profiling chamber from the second of the at least two headers;

an inlet for each pipe in the header;

an outlet for each pipe in each compartment;

a pressure responsive valve actuator associated with each pipe;

a piston extending from the valve actuator to the pipe outlet at each compartment whereby control of the steam supply from the header to the compartment can be achieved to provide control of the steam output through the passageways in said profiling chamber in a cross machine direction.

17. Apparatus as claimed in claim 10 in which there is a further header arranged eccentrically within the first header to receive steam from the steam supply means;

outlets formed in the further header so that steam may pass from the further header to the first header, the eccentric arrangement ensuring a uniform flow of steam from the outlets in said further header to the first header.

18. Apparatus as claimed in claim 14 in which the openings comprise a plurality of rows of holes.

19. Apparatus as claimed in claim 16, in which said pipe extends from a tap in a side of the second header, through the profiling chamber, the pressure responsive valve actuator generally extending upwardly.

* * * * *